US008417130B2

(12) United States Patent
Hashimoto

(10) Patent No.: US 8,417,130 B2
(45) Date of Patent: Apr. 9, 2013

(54) IMAGE FORMING DEVICE HAVING PROCESS UNIT THAT CAN BE PULLED OUT THEREOF

(75) Inventor: Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 230 days.

(21) Appl. No.: 13/010,244

(22) Filed: Jan. 20, 2011

(65) Prior Publication Data

US 2011/0211866 A1 Sep. 1, 2011

(30) Foreign Application Priority Data

Feb. 26, 2010 (JP) ..... 2010-042641

(51) Int. Cl.
*G03G 15/08* (2006.01)

(52) U.S. Cl. ..... 399/12; 399/113; 399/119

(58) Field of Classification Search ..... 399/12, 399/13, 113
See application file for complete search history.

(56) References Cited

U.S. PATENT DOCUMENTS

| | | | | |
|---|---|---|---|---|
| 5,311,253 | A * | 5/1994 | Ohmori et al. | 399/13 |
| 7,116,919 | B2 | 10/2006 | Ishii | |
| 7,146,121 | B2 | 12/2006 | Horinoe et al. | |
| 7,742,708 | B2 | 6/2010 | Fukusada | |
| 7,756,426 | B2 * | 7/2010 | Kamimura | 399/12 |
| 7,756,443 | B2 | 7/2010 | Okabe et al. | |
| 7,853,158 | B2 * | 12/2010 | Mikuni | 399/12 |
| 7,941,072 | B2 | 5/2011 | Ishikawa et al. | |
| 7,953,330 | B2 | 5/2011 | Ishikawa | |
| 7,970,293 | B2 * | 6/2011 | Ishikawa et al. | 399/12 |
| 7,978,997 | B2 * | 7/2011 | Tokuda | 399/90 |
| 7,991,322 | B2 | 8/2011 | Ukai | |
| RE42,796 | E | 10/2011 | Ishii | |
| 2005/0031359 | A1 * | 2/2005 | Ishii | 399/12 |
| 2005/0100363 | A1 | 5/2005 | Horinoe et al. | |
| 2007/0031158 | A1 | 2/2007 | Kamimura | |
| 2007/0147881 | A1 | 6/2007 | Okabe et al. | |

(Continued)

FOREIGN PATENT DOCUMENTS

| | | | |
|---|---|---|---|
| JP | 63271489 | A | 11/1988 |
| JP | 3279965 | A | 12/1991 |

(Continued)

OTHER PUBLICATIONS

Office Action for Japanese patent application No. 2010-042641 mailed Feb. 7, 2012.

*Primary Examiner* — David Gray
*Assistant Examiner* — Carla Therrien
(74) *Attorney, Agent, or Firm* — Banner & Witcoff, Ltd

(57) ABSTRACT

An image forming device includes a main body, a support unit, a driving unit, a developer cartridge, a moving member, a transmitting member, and a detection member. The support unit can be pulled out from the main body in a removing direction. The developer cartridge is detachably mounted in the support unit and has a driving member. The driving member is driven by the driving unit when the developer cartridge is mounted in the support unit. The moving member moves when the driving member is driven by the driving unit. The transmitting member is provided to the support unit and is rotatable about a rotational axis which extends perpendicular to the removing direction and a longitudinal direction of a photosensitive member. When the moving member contacts the transmitting member, the transmitting member rotates. The detection member detects a rotation of the transmitting member.

28 Claims, 9 Drawing Sheets

U.S. PATENT DOCUMENTS

| | | | |
|---|---|---|---|
| 2008/0205911 | A1 | 8/2008 | Ishikawa et al. |
| 2008/0223173 | A1 | 9/2008 | Ishikawa |
| 2008/0317480 | A1 | 12/2008 | Fukusada |
| 2009/0000423 | A1 | 1/2009 | Ishikawa et al. |
| 2009/0269085 | A1 | 10/2009 | Ukai |

FOREIGN PATENT DOCUMENTS

| | | | |
|---|---|---|---|
| JP | 2005055544 | A | 3/2005 |
| JP | 2005114976 | A | 4/2005 |
| JP | 2007-047314 | | 2/2007 |
| JP | 2008216394 | A | 9/2008 |
| JP | 2008233940 | A | 10/2008 |
| JP | 2009003384 | A | 1/2009 |
| JP | 2009014789 | A | 1/2009 |
| JP | 2009244564 | A | 10/2009 |
| JP | 2009265391 | A | 11/2009 |

* cited by examiner

IMAGE FORMING DEVICE HAVING PROCESS UNIT THAT CAN BE PULLED OUT THEREOF

CROSS REFERENCE TO RELATED APPLICATION

This application claims priority from Japanese Patent Application No. 2010-042641 filed Feb. 26, 2010. The entire content of this priority application is incorporated herein by reference.

TECHNICAL FIELD

The present invention relates to an image-forming device, such as a laser printer.

BACKGROUND

In a conventional laser printer employing an electrophotographic system, developer cartridges accommodating toner are detachably mounted in the laser printer.

This type of laser printer may be provided with a new cartridge detection unit for detecting whether a mounted developer cartridge is new and for determining the service life of a developer cartridge found to be new.

One such laser printer that has been proposed is a color laser printer having a detection gear provided on each developer cartridge, a corresponding lever that moves when contacted by the detection gear, a drum unit that can be pulled out of the printer's main casing, and photosensors provided in the main casing for detecting movement of the levers.

In this conventional color laser printer, the developer cartridges are mounted in the main casing together with the drum unit. A motor provided in the main casing generates a drive force that is transmitted to each developer cartridge. The drive force rotates the detection gear so that the gear contacts the corresponding lever, moving the lever to a position protruding from the drum unit. When the photosensor detects this movement of the lever, the color laser printer can determine that the developer cartridge is new based on the detection. The detection gear is a sector gear that rotates a prescribed angle only when the developer cartridge is new and does not move when the developer cartridge is not new.

SUMMARY

In the conventional color laser printer described above, a problem could occur if the power of the color laser printer were interrupted after a new developer cartridge is mounted in the main casing and while the printer is performing the new cartridge detection operation described above. In such a case, the color laser printer is shut down while the lever still remains protruding from the drum unit and while the photosensor is detecting the lever.

Consequently, if an operator attempts to remove the drum unit from the main casing, the lever may contact components ambient to the photosensor in the main casing causing damage to the same.

Therefore, it is an object of the present invention to provide an image-forming device capable of preventing the lever from being damaged.

In view of the foregoing, it is an object of the invention to provide an image forming device. The image forming device includes a main body, a support unit, a driving unit, a developer cartridge, a moving member, a transmitting member, a detection member, and an information determining unit. The support unit is disposed in the main body and is capable of being pulled out from the main body in a removing direction. The support unit supports a photosensitive member. The driving unit is provided in the main body. The developer cartridge is detachably mounted in the support unit and has a developer member and a driving member. The driving member is driven by the driving unit at a prescribed amount when the developer cartridge is mounted in the support unit. The moving member moves when the driving member is driven by the driving unit. The transmitting member is provided to the support unit and is rotatable about a rotational axis which extends perpendicular to both the removing direction and a longitudinal direction of the photosensitive member. When the moving member contacts the transmitting member, the transmitting member rotates to let the moving member pass over the transmitting member. The detection member is provided in the main body and detects a rotation of the transmitting member. The information determining unit determines information of the developer cartridge based on detection results of the detection member.

According to another aspect of the present invention, the present invention provides an image forming device. The image forming device includes a main body, a support unit, and a cartridge. The main body has a driving unit and a detection member. The support unit is disposed in the main body and is configured to be pulled out from the main body in a removing direction. The support unit has a transmitting member configured to rotate about a rotation axis. The detection member detects a rotation of the transmitting member. The cartridge is detachably mounted in the support unit and accommodates developer. The cartridge has a driving member driven by the driving unit at a prescribed amount when the cartridge is mounted in the support unit, and a moving member that moves when the driving member is driven by the driving unit. The transmitting member rotates to let the moving member pass over the transmitting member when the moving member contacts the transmitting member. The rotation axis of the transmitting member extends perpendicular to both the removing direction and a longitudinal direction of the cartridge.

According to still another aspect of the present invention, the present invention provides a support unit. The support unit is capable of being pulled out from an image forming device in a removing direction. The support unit includes a main frame, a transmitting member, and a cartridge. The transmitting member is configured to rotate about a rotation axis. The cartridge is detachably mounted in the main frame and accommodating developer. The cartridge has a driving member driven at a prescribed amount when the cartridge is mounted in the main frame, and a moving member that moves when the driving member is driven. The transmitting member rotates to let the moving member pass over the transmitting member when the moving member contacts the transmitting member. The rotation axis of the transmitting member extends perpendicular to both the removing direction and a longitudinal direction of the cartridge.

BRIEF DESCRIPTION OF THE DRAWINGS

The particular features and advantages of the invention as well as other objects will become apparent from the following description taken in connection with the accompanying drawings, in which:

FIG. 3(*b*) is a cross sectional view of the process unit, taken along a line III-III in FIG. 2

FIG. 5(*b*) is a diagram explaining the detection operation before moving the detection gear and illustrating ambient to the process-side actuator as viewed from top;

DETAILED DESCRIPTION

Figure 1:
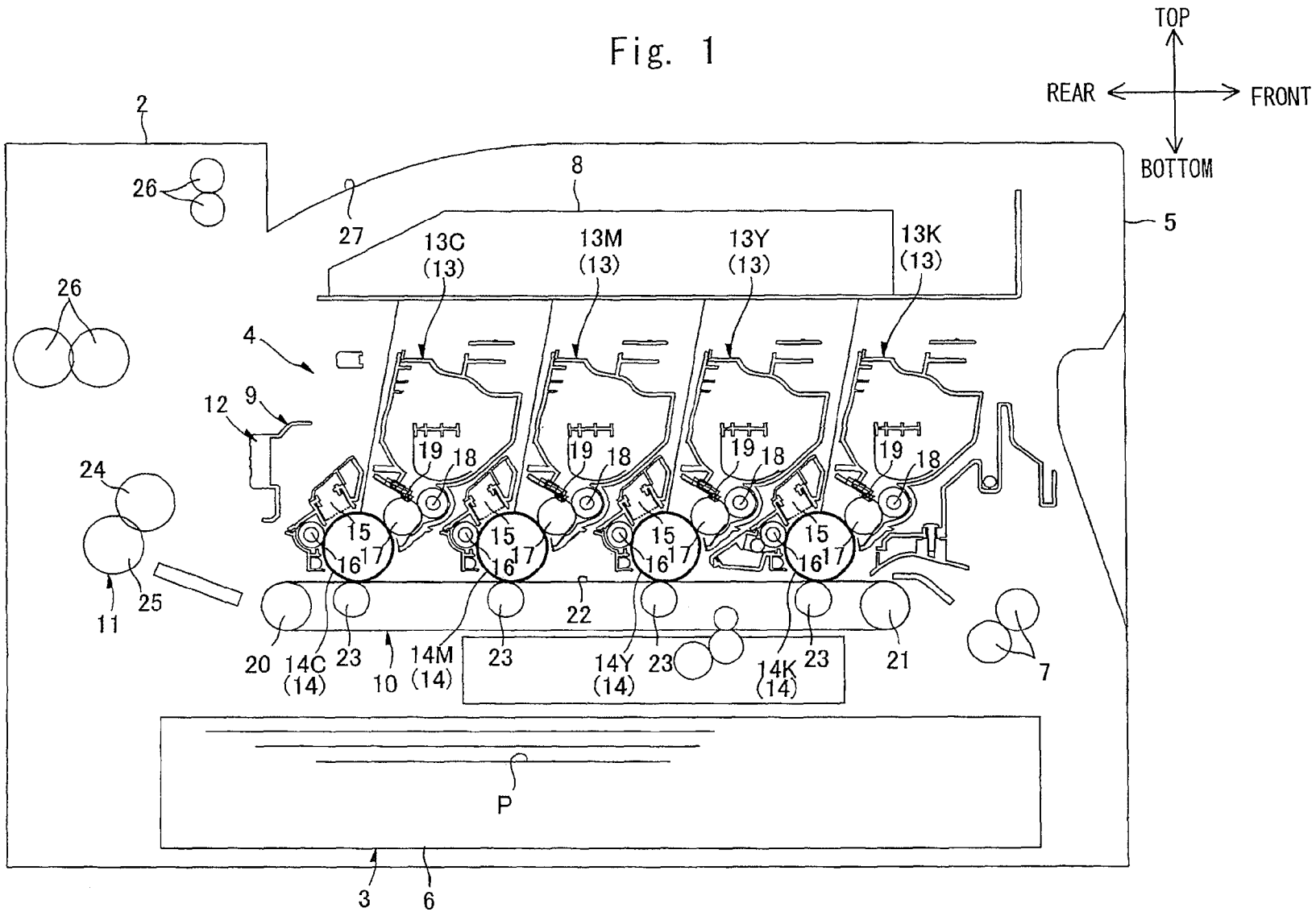
FIG. 1 is a cross-sectional view showing a color laser printer according to an embodiment of the present invention.

A color laser printer 1 according to an embodiment of the invention will be described while referring to the accompanying drawings wherein like parts and components are designated by the same reference numerals to avoid duplicating description.

1. Overall Structure of a Color Laser Printer

The color laser printer 1 is a direct tandem color laser printer of a horizontal type, whereby photosensitive drums for forming individual colors are juxtaposed horizontally in a tandem arrangement. The color laser printer 1 includes a main casing 2, a sheet-feeding unit 3 provided in the main casing 2 for feeding sheets of a paper P to be printed, and an image-forming unit 4 for forming images on the paper P supplied by the sheet-feeding unit 3.

(1) Main Casing

The main casing 2 has a substantially rectangular box shape in a side view for accommodating the sheet-feeding unit 3 and the image-forming unit 4. A front cover 5 is provided on one side wall of the main casing 2. The front cover 5 is capable of pivoting relative to the main casing 2 about its lower end and, thus, can be opened to allow mounting and removing a process unit 9 described later.

In the following description, the side of the main casing 2 on which the front cover 5 is provided (the right side in FIG. 1) will be called the "front side," and the opposite side (the left side in FIG. 1) will be called the "rear side." Further, the left and right sides of the main casing 2 will be based on the perspective of an operator looking at the printer 1 from the front side. In other words, the near side in FIG. 1 will be the "left side," while the far side in FIG. 1 will be the "right side."

(2) Sheet-Feeding Unit

The sheet-feeding unit 3 includes a paper tray 6 for accommodating paper P. The paper tray 6 is removably mounted in the bottom section of the main casing 2. A pair of registration rollers 7 is disposed above the front end of the paper tray 6.

The paper P accommodated in the paper tray 6 are fed toward the registration rollers 7 one sheet at a time, and the registration rollers 7 convey the paper P toward the image-forming unit 4 (between photosensitive drums 14 and a conveying belt 22 described later) at a prescribed timing.

(3) Image-Forming Unit

The image-forming unit 4 includes a scanning unit 8, the process unit 9, a transfer unit 10, and a fixing unit 11.

(3-1) Scanning Unit

The scanning unit 8 is disposed in the top section of the main casing 2. As indicated by solid lines in FIG. 1, the scanning unit 8 irradiates laser beams toward four photosensitive drums 14, described later, based on image data for selectively exposing the photosensitive drums 14.

(3-2) Process Unit (3-2-1) Structure of the Process Unit

The process unit 9 is disposed in the main casing 2 below the scanning unit 8 and above the transfer unit 10. The process unit 9 includes a process frame 12, and four developer cartridges 13 provided for each of the four printing colors. The process unit 9 can be mounted in and removed from the main casing 2 by sliding in the front-to-rear direction.

The process frame 12 is disposed in the main casing 2 and can be pulled out of the main casing 2 in a forwardly direction. The process frame 12 retains the photosensitive drums 14, Scorotron chargers 15, and drum cleaning rollers 16.

The four photosensitive drums 14 are arranged parallel to each other with their axes extending in the left-to-right direction (longitudinal direction) and are spaced at intervals in the front-to-rear direction. The photosensitive drums 14 specifically include, in order from front to rear, a black photosensitive drum 14K, a yellow photosensitive drum 14Y, a magenta photosensitive drum 14M, and a cyan photosensitive drum 14C.

The Scorotron chargers 15 are positioned diagonally above and rearward of the respective photosensitive drums 14. The Scorotron chargers 15 face the respective photosensitive drums 14 but are separated therefrom.

The drum cleaning rollers 16 are disposed on the rear side of the respective photosensitive drums 14, confronting and contacting the same.

Each of the developer cartridges 13 is removably mounted in the process frame 12 above corresponding photosensitive drum 14 so as to confront the photosensitive drum 14. The developer cartridges 13 specifically include, in order from front to rear, a black developer cartridge 13K, a yellow developer cartridge 13Y, a magenta developer cartridge 13M, and a cyan developer cartridge 13C. Each of the developer cartridges 13 is also provided with a developing roller 17.

Figure 4:
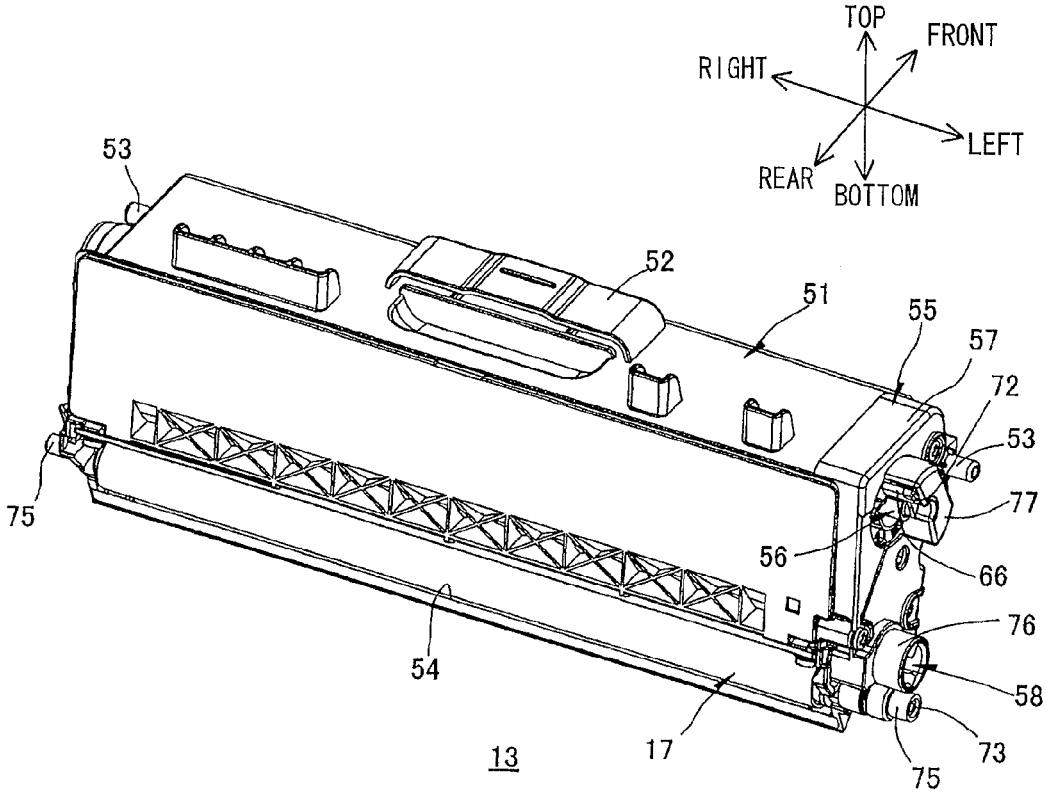
FIG. 4 is a perspective view showing a developer cartridge as viewed from upper left.

As will be described later, the developing roller 17 is rotatably supported in the lower end of the developer cartridge 13 so that the peripheral surface of the developing roller 17 is exposed on the rear side (FIG. 4). The developing roller 17 opposes and contacts the upper front edge of the corresponding photosensitive drum 14 (FIG. 1).

Each developer cartridge 13 further includes a supply roller 18 for supplying toner to the developing roller 17 and a thickness-regulating blade 19 for regulating the layer thickness of toner supplied to the developing roller 17. The developer cartridge 13 also has an interior space in the upper section for accommodating the toner of a corresponding color.

(3-2-2) Developing Operations of the Process Unit

The toner accommodated in the developer cartridge 13 is supplied onto the supply roller 18, and the supply roller 18 in turn supplies the toner to the developing roller 17. The toner is positively tribocharged between the supply roller 18 and the developing roller 17.

As the developing roller 17 rotates, the thickness-regulating blade 19 regulates the thickness of the toner supplied to the developing roller 17 so that the developing roller 17 carries a uniform thin layer of the toner on the surface thereof.

In the meantime, the Scorotron charger 15 applies a uniform positive charge to the surface of the photosensitive drum 14 as the photosensitive drum 14 rotates. Subsequently, the scanning unit 8 irradiates laser beams (indicated by solid lines in FIG. 1), exposing the surfaces of the respective photosensitive drums 14 in a high-speed scan to form electrostatic latent images on the surfaces of the photosensitive drums 14 corresponding to an image to be formed on the paper P.

As the photosensitive drum 14 continues to rotate, the positively charged toner carried on the surface of the developing roller 17 is supplied to the electrostatic latent image formed on the surface of the photosensitive drum 14. The toner develops the latent image into a visible toner image by reversal.

(3-3) Transfer Unit

The transfer unit 10 is disposed inside the main casing 2 above the sheet-feeding unit 3 and below the process unit 9. The transfer unit 10 extends in the front-to-rear direction. The transfer unit 10 includes a drive roller 20, a follow roller 21, the conveying belt 22, and four transfer rollers 23.

The drive roller 20 and the follow roller 21 are disposed in parallel to each other and separated in the front-to-rear direction.

The conveying belt 22 is looped around the drive roller 20 and the follow roller 21 and is positioned so that an upper portion of the conveying belt 22 confronts and contacts each of the photosensitive drums 14 from above. When the drive roller 20 is driven to rotate, the conveying belt 22 circulates so that the upper portion in contact with the photosensitive drums 14 moves rearward.

Each of the transfer rollers 23 is disposed within the inner space defined by the conveying belt 22 at a position opposing the corresponding photosensitive drum 14 through the upper portion. The position between each photosensitive drum 14 and the corresponding transfer roller 23 will be called a "transfer position."

When the paper P is supplied from the sheet-feeding unit 3 onto the conveying belt 22, the conveying belt 22 conveys the paper P rearward so that the paper P passes sequentially through the transfer positions between the photosensitive drums 14 and the respective transfer rollers 23. As the conveying belt 22 conveys the paper P, toner images of the respective colors are sequentially transferred from the photosensitive drum 14 onto the paper P to form a color image thereon.

In some cases, toner remains on the surface of the photosensitive drum 14 after the toner image has been transferred from the photosensitive drum 14 to the paper P. This residual waste toner is transferred to the corresponding drum cleaning roller 16 by a cleaning bias applied to the drum cleaning roller 16 when the waste toner carried on the rotating photosensitive drum 14 opposes the drum cleaning roller 16, and the drum cleaning roller 16 retains the waste toner.

(3-4) Fixing Unit

The fixing unit 11 is positioned on the rear side of the transfer unit 10. The fixing unit 11 includes a heating roller 24 and a pressure roller 25 disposed in confrontation with the heating roller 24. After the color image is transferred onto the paper P, the color image is fixed to the paper P by heat and pressure as the paper P passes between the heating roller 24 and the pressure roller 25 in the fixing unit 11.

(4) Sheet Discharge

A U-shaped conveying path is formed in the main casing 2 on the downstream side of the fixing unit 11 in the sheet conveying direction and leads from the fixing unit 11 to a sheet-discharge tray 27 formed above the scanning unit 8. Pairs of discharge rollers 26 are provided along the U-shaped path. After the toner image has been fixed to the conveying paper P in the fixing unit 11, the discharge rollers 26 convey the paper P along the U-shaped conveying path and discharge the paper P onto the sheet-discharge tray 27.

2. Detailed Description of the Process Unit (1) Process Frame

Figure 2:
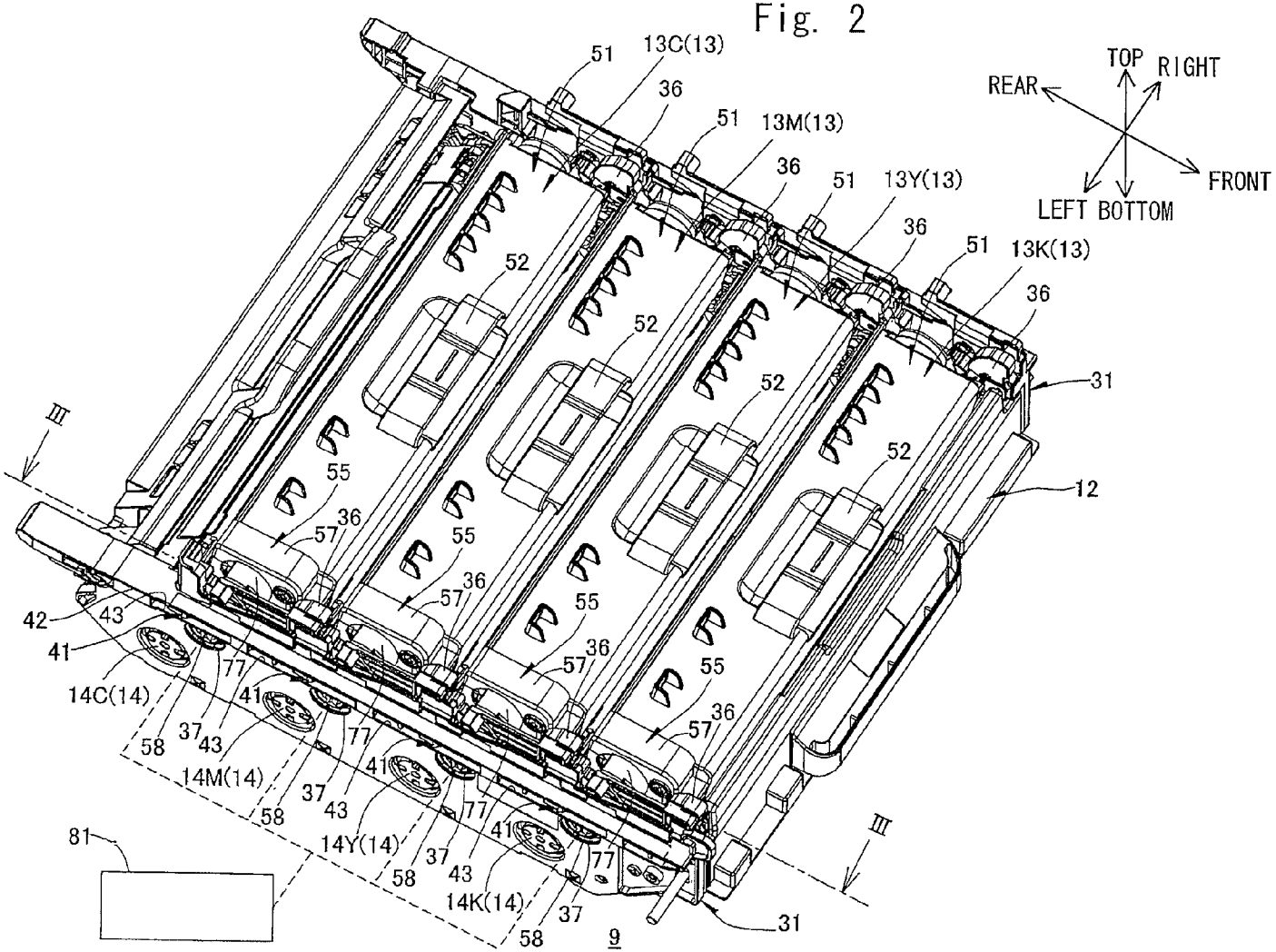
FIG. 2 is a perspective view showing a process unit as viewed from upper left.

As shown in FIG. 2, the process frame 12 has a substantially rectangular frame-like shape elongated in the front-to-rear direction in a plan view. The process frame 12 is provided with a pair of left and right side plates 31.

Figure 3A:
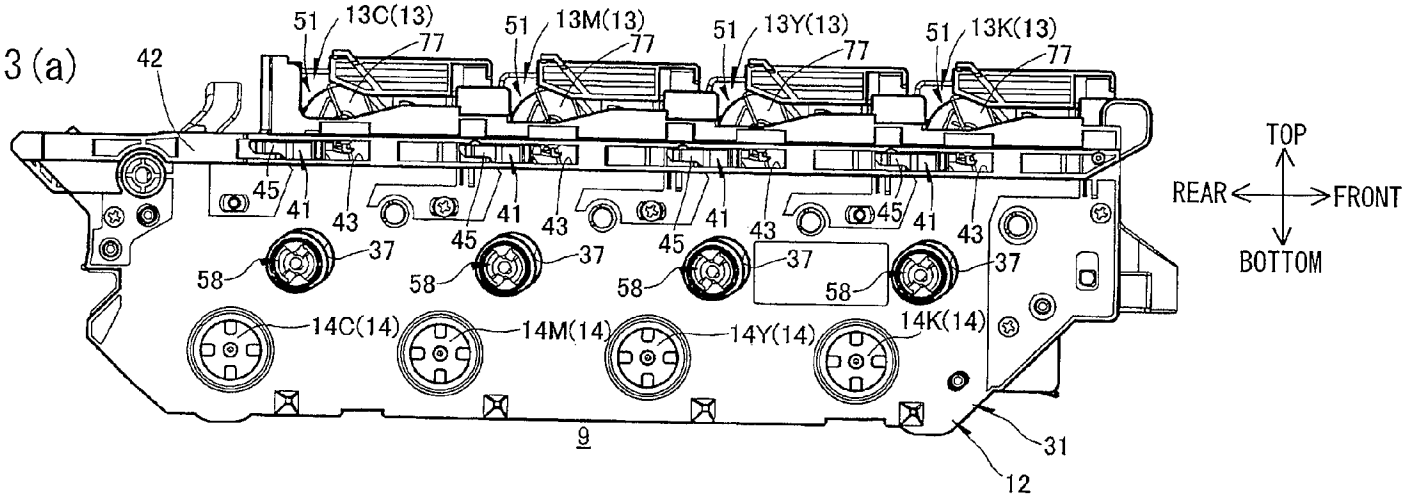
FIG. 3(*a*) is a left side view of the process unit.
Figure 3B:
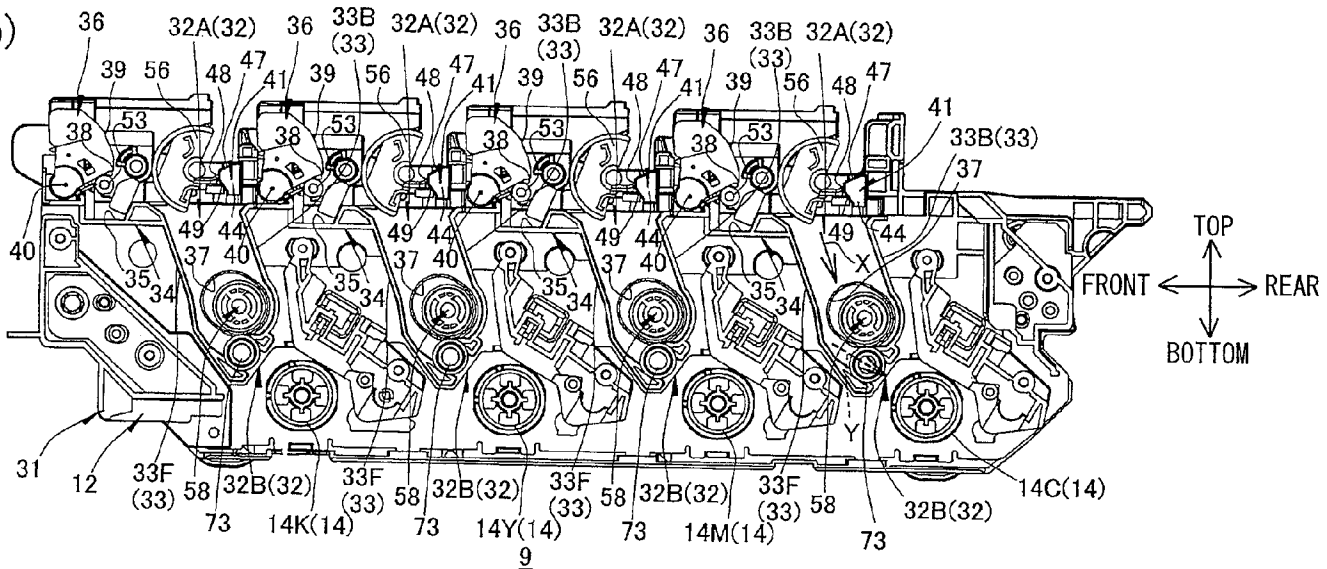

The left and right side plates 31 are arranged parallel to each other and separated in the left-to-right direction. As illustrated in FIGS. 3(*a*) and 3(*b*), both left and right side plates 31 are formed in a substantially rectangular shape elongated in the front-to-rear direction.

Each of the left and right side plates 31 has four guide grooves 32 (FIG. 3(*b*)) formed therein and is provided with a guide rail 42 (FIG. 3(*a*)).

In the preferred embodiment, a construction related to a process-side actuator 41 described later is provided only for the left side plate 31. Below, the left side plate 31 will be described in detail, while a description of the right side plate 31 will be omitted. In the following description, the left side plate 31 will simply be referred to as the "side plate 31."

The four guide grooves 32 evenly spaced in the front-to-rear direction are formed in the right surface (inner surface with respect to the left-to-right direction) of the side plate 31 and respectively corresponding to the photosensitive drums 14. Each of the guide grooves 32 extends downward from the upper edge of the side plate 31 in a rearward sloping direction, i.e., in a first sloping direction X indicated by a solid arrow in FIG. 3(*b*), and is substantially U-shaped with the top portion open in the upper edge of the side plate 31. The guide groove 32 is formed on the upper front side of the corresponding photosensitive drum 14.

More specifically, four pairs of guide ribs 33 are formed on the right surface of the side plate 31 for defining the respective guide grooves 32. Each pair of individual guide ribs 33 includes a front rib 33F on the front side and back rib 33B on the rear side.

The guide ribs 33 are separated from each other in the front-to-rear direction and extend along the first sloping direction X while protruding outward toward the right. The lower ends of the guide ribs 33 are opposite to and away from the corresponding photosensitive drum 14 by a small gap.

The front rib 33F extends from the upper edge of the side plate 31 in a substantially straight line along the first sloping direction X, and then curves rearward and extends in a second direction Y indicated by a dotted arrow in FIG. 3(*b*), which is a direction following a radial direction of the photosensitive drum 14.

The back rib 33B extends from the upper edge of the side plate 31 in a substantially straight line along the first sloping direction X, and then protrudes rearward in an arc shape so as to slightly increase the width of the guide groove 32 (distance between the front rib 33F and the back rib 33B in the front-to-rear direction). The bottom end of the back rib 33B is opposite to the lower end of the front rib 33F with a gap therebetween that is substantially equivalent to the diameter of a developing roller shaft 73 (described later). The lower edge of the back rib 33B extends along the second sloped direction Y.

In other words, each guide groove 32 is configured of a first guide groove 32A extending from the upper edge of the side plate 31 along the first sloping direction X, and a second guide groove 32B in continuous communication with the first guide groove 32A and extending from the bottom end of the first guide groove 32A along the second sloped direction Y.

The side plate 31 is formed with a coupling hole 37 at a position between each front rib 33F and the arc-shaped part of the corresponding back rib 33B.

The coupling hole 37 is an elongated hole extending along a direction sloping downward toward the rear. Through the coupling hole 37, a coupling member 58 (described later) of the developer cartridge 13 is exposed on the left side of the side plate 31.

As shown in FIG. 3(*a*), the guide rail 42 extends in the front-to-rear direction so as to pass through the upper edges of the guide grooves 32. The guide rail 42 is formed as a ridge that projects leftward from the left side surface of the side plate 31. The guide rail 42 has a vertical dimension set slightly larger than the vertical dimension of a detection target part 45 of the process-side actuator 41 (described later) and a front-to-rear dimension spanning substantially the entire front-to-rear dimension of the side plate 31.

The guide rail 42 is provided with four accommodating parts 43 and the four process-side actuators 41 accommodated in the respective accommodating parts 43.

The accommodating parts 43 are configured of openings that penetrate the guide rail 42 (and the side plate 31) in the left-to-right direction. Each accommodating part 43 has a substantially rectangular shape in a side view elongated in the front-to-rear direction. The four accommodating parts 43 are arranged at intervals in the front-to-rear direction and are positioned above the respective back ribs 33B so as to oppose the corresponding guide grooves 32. A support shaft 61 (FIG. 5(*b*)) extending vertically, i.e., extending perpendicular to both the longitudinal direction of the photosensitive drums 14 and a direction in which the process unit 9 can be mounted in and removed from the main casing 2, is disposed in each accommodating part 43.

One process-side actuator 41 is disposed in each accommodating part 43 and is supported on the support shaft 61 so as to be capable of rotating relative to the support shaft 61.

Figure 5A:
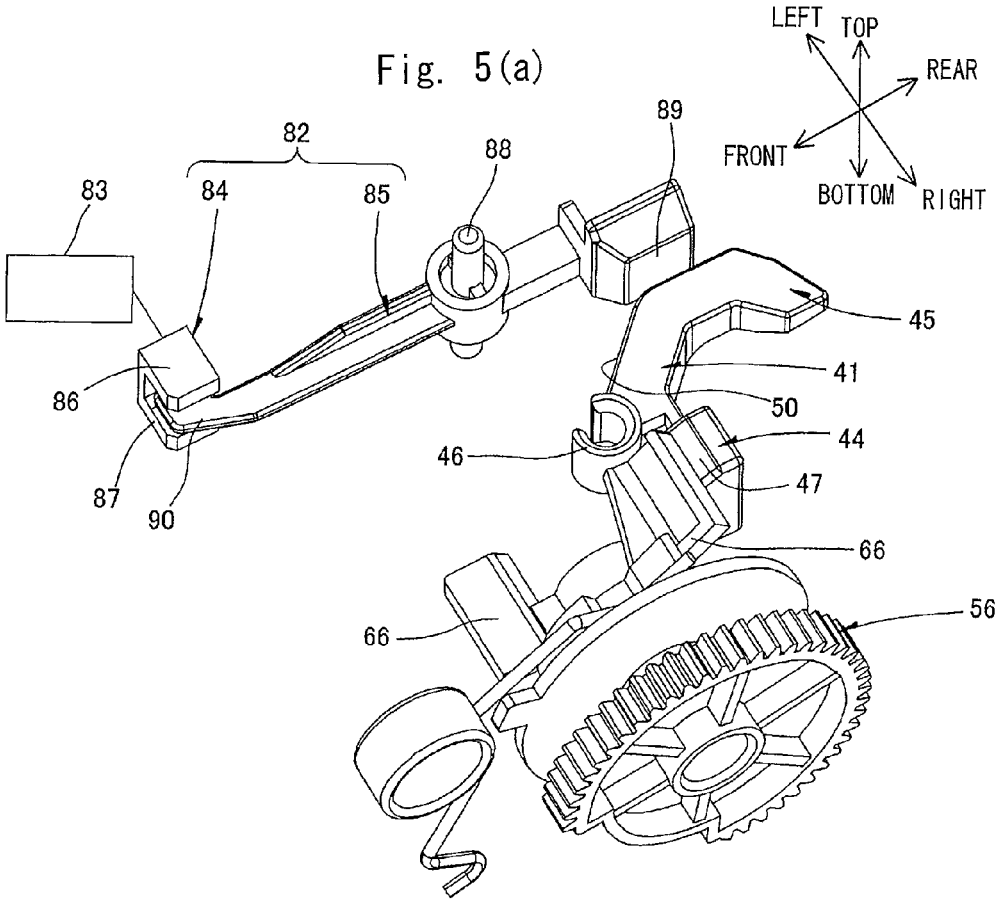
FIG. 5(*a*) is a diagram explaining a detection operation before moving a detection gear and illustrating ambient to a process-side actuator as viewed from upper right.
Figure 5B:
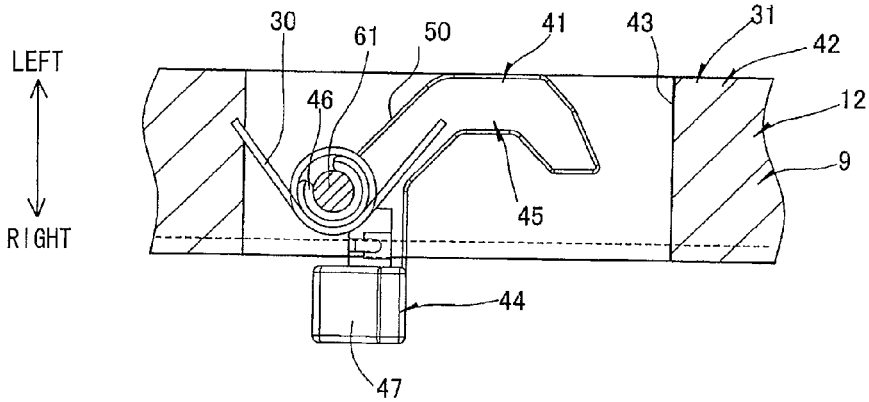

As shown in FIGS. 5(*a*) and 5(*b*), the process-side actuator 41 extends in the right-to-left direction, with the left end bent rearward to form a hook-like shape in a plan view. The process-side actuator 41 includes a contact part 44, the detection target part 45, and a fitting part 46.

Figure 8:
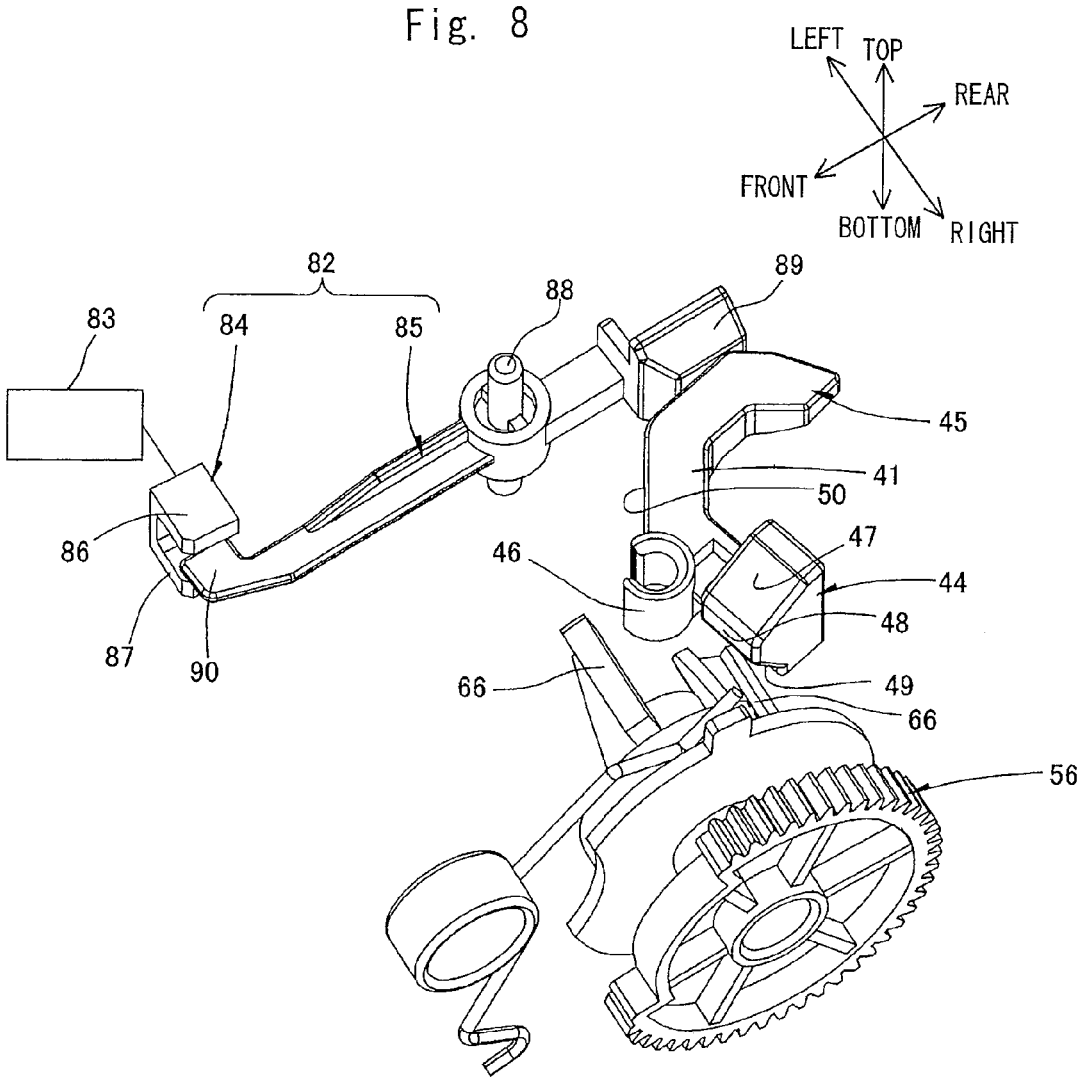
FIG. 8 is a diagram explaining the detection operation when the detection gear contacts a second sloped surface of the process-side actuator.

The contact part 44 is provided on the right end of the process-side actuator 41. When viewed from the side, the contact part 44 is substantially triangular in shape, with a vertex of the triangle pointing forward (FIG. 3(*b*)). As shown in FIG. 8, the contact part 44 is configured of a first sloped surface 47, a positioning surface 48, and a second sloped surface 49.

The first sloped surface 47 constitutes the top surface of the contact part 44 and slopes downward toward the front side.

The positioning surface 48 is the surface formed on the front vertex of the contact part 44 and extends downward from the front edge of the first sloped surface 47. The second sloped surface 49 is the bottom surface of the contact part 44 and slopes from the bottom edge of the positioning surface 48 in a direction downward toward the rear.

As shown in FIG. 5(*a*), the detection target part 45 extends leftward from the left surface of the contact part 44, curves and extends toward the left rear, curves further and extends toward the rear, and finally curves toward the right rear at the end thereof The front surface on the portion of the detection target part 45 extending toward the left rear functions as a pressing surface 50.

The pressing surface 50 slopes rearward toward the left side so as to rotate in a clockwise direction in FIG. 5(*b*) about the support shaft 61 upon being pressed from front side. That is, directions orthogonal to the pressing surface 50 include a direction sloping rightward toward the rear side. In other words, directions orthogonal to the pressing surface 50 include a clockwise direction around the rotational center of the support shaft 61 in a plan view.

The fitting part 46 is disposed on the front edge of the part of the detection target part 45 bent toward the left rear. The fitting part 46 extends vertically and is substantially cylindrical in shape. In a plan view, the fitting part 46 is shaped substantially like the letter C, with the opening of the "C" facing in the front left direction.

As shown in FIG. 5(*b*), the process-side actuator 41 is disposed in the accommodating part 43 so that the contact part 44 protrudes rightward from the right surface of the guide rail 42 of the side plate 31 and the detection target part 45 is exposed on the left side of the side plate 31 and is at inside the left side surface of the guide rail 42 of the side plate 31 (left edge of the accommodating part 43). The fitting part 46 is rotatably supported by the support shaft 61 provided in the accommodating part 43, i.e., the fitting part 46 of the process-side actuator 41 is capable of rotating in a horizontal plane.

As shown in FIG. 3(*b*), the contact part 44 is disposed above the back rib 33B so that the second sloped surface 49 extends along the first sloping direction X and is substantially flush with the front surface of the back rib 33B.

As shown in FIG. 5(*b*), a coil spring 30 is wound about the fitting part 46 of the process-side actuator 41. One end of the coil spring 30 is fixed to an inner wall of the accommodating part 43, and the other end is fixed to the detection target part 45 of the process-side actuator 41. The urging force of the coil spring 30 constantly urges the process-side actuator 41 to rotate in a clockwise direction in a plan view so that the detection target part 45 is accommodated in the accommodating part 43 (FIG. 5(*b*)). In other words, the detection target part 45 is usually in an accommodated position where the detection target part 45 is within the accommodating part 43.

As shown in FIG. 3(*b*), an extension part 34 is provided on the right surface of the side plate 31 at a position between each pair of adjacent guide grooves 32, and also at a position forward of the forwardmost guide groove 32.

Each extension part 34 extends in the front-to-rear direction and connects the top edge of the front rib 33F forming the guide groove 32 on the rear side with the top edge of the back rib 33B forming the guide groove 32 on the front side except the forwardmost extension part 34 which is connected only to the top edge of the front rib 33F forming the guide groove 32 on the rear side. A recession 35 is formed in the top surface of each extension part 34.

Four pressing members 36 are provided at the upper edge on the right surface of the side plate 31 in one-to-one correspondence with the guide grooves 32. The four pressing members 36 are provided at positions upwardly adjacent to the respective extension parts 34.

Each pressing member 36 is substantially fan-shaped in a side view. Specifically, each pressing member 36 includes a pair of flat portions 38, and a curved portion 39. The distance between the pair of flat portions 38 expands gradually in a direction upward and rearward toward the curved portion 39. The curved portion 39 connects the upper rear ends of the flat portions 38 and has a substantially arc shape that expands outward in a direction diagonally upward and rearward.

The pressing member 36 has a rotational shaft 40 extending outward from the pressing member 36 in left to right direction near the area at which the lower front ends of the two flat portions 38 are joined. Left end of the rotational shaft 40 is supported in the inner surfaces (right surface) of the side plate 31, whereby the pressing member 36 is rotatably supported about the rotational shaft 40. An urging member (not shown) is provided for constantly urging the pressing member 36 counterclockwise in a left-side view.

(2) Developer Cartridge

As shown in FIGS. 1 and 4, each developer cartridge 13 includes a frame 51, in addition to the developing roller 17 and the supply roller 18 described above.

The frame 51 has a box shape elongated in the left-to-right direction. In a side view, the frame 51 is shaped substantially like an isosceles triangle with a vertex pointing diagonally downward and rearward.

A handle 52 and a pair of left and right bosses 53 are provided in the top front portion of the frame 51. An opening 54 is formed in the bottom rear side of the frame 51.

The handle 52 is disposed in the left-to-right center of the frame 51 and is elongated in the left-to-right direction. The handle 52 is formed to protrude upward from the top edge of the frame 51.

The bosses 53 are substantially cylindrical in shape and protrude outward in the left and right directions from the respective left and right endfaces of the frame 51.

The opening 54 is formed across the entire left-to-right dimension of the frame 51, opening toward the rear.

The frame 51 is also provided with a drive unit 55. The drive unit 55 is disposed on the left end of the frame 51 and includes the coupling member 58, a detection gear 56, and a gear cover 57. The coupling member 58 is a female coupling member having a substantially cylindrical shape and is rotatably provided on the lower rear end of the developer cartridge 13.

When the developer cartridge 13 is mounted in the main casing 2, a male coupling member (not shown) provided in the main casing 2 couples with the left end of the coupling member 58 from the left side thereof. Through this coupling, a motor 81 (described later with reference to FIG. 2) provided in the main casing 2 can input a drive force to the coupling member 58.

As shown in FIG. 5(*a*), the detection gear 56 is a sector gear disposed in the top portion of the developer cartridge 13. More specifically, the detection gear 56 has gear teeth on approximately four-fifths of its circumference and no teeth on the remaining approximately one-fifth. The detection gear 56 is provided with two contact protrusions 66. The detection gear 56 rotates at a prescribed amount only when the developer cartridge 13 is new and does not move when the developer cartridge 13 is not new.

Each contact protrusion 66 is substantially plate-shaped, extends radially outward from the approximate radial center of the detection gear 56 and protrudes leftward from the left surface of the detection gear 56. The contact protrusions 66 are positioned so that one contact protrusion 66 is disposed on the opposite side of the detection gear 56 from the toothless region with respect to the radial center of the detection gear 56, while the other contact protrusion 66 is separated from the one contact protrusion 66 by approximately 120 degrees in a clockwise direction in a left-side view along the circumferential direction of the detection gear 56. The number and shape of the contact protrusions 66 corresponds to information about the developer cartridge 13 (information indicating whether the developer cartridge is new, the number of sheets that can be printed with the developer cartridge, etc.).

The detection gear 56 is rotatably provided on the frame 51, with the one contact protrusion 66 pointing upward and the toothless region of the detection gear 56 facing downward. A gear train (not shown) is provided between and intermeshed with the detection gear 56 and the coupling member 58. Through this gear train, the coupling member 58 can transmit the drive force to the detection gear 56.

As shown in FIG. 4, the gear cover 57 includes a coupling cover 76, and a detection gear cover 77. The coupling cover 76 has a substantially cylindrical shape and extends leftward from the left surface of the gear cover 57 near the lower edge thereof for encircling the coupling member 58.

The detection gear cover 77 is semicylindrical in shape and extends leftward from the left surface of the gear cover 57 for accommodating the detection gear 56. In a side view, the detection gear cover 77 is substantially semicircular in shape and is closed on its endface. An exposure opening 72 is formed in the rear portion of the detection gear cover 77 for exposing the contact protrusion 66.

The developing roller 17 is disposed in the lower end of the frame 51, with its axis extending in the left-to-right direction. The rear circumferential surface of the developing roller 17 is exposed through the opening 54. The developing roller 17 also includes the developing roller shaft 73. Collar members 75 are fitted over each of the left and right ends of the developing roller shaft 73.

By rotatably supporting the left and right ends of the developing roller shaft 73 in the left and right sides of the frame 51, the developing roller 17 is rotatably supported in the frame 51. As shown in FIG. 1, the supply roller 18 is disposed diagonally above and forward of the developing roller 17 and contacts the top front circumferential portion of the developing roller 17. The supply roller 18 is also provided with a supply roller shaft (not shown).

By rotatably supporting the left and right ends of the supply roller shaft in the left and right sides of the frame 51, the supply roller 18 is rotatably supported in the frame 51.

A gear (not shown) is fixedly provided on the left end of the developing roller shaft 73 and cannot rotate relative to the same. Similarly, a gear (not shown) is fixedly provided on the left end of the supply roller shaft and cannot rotate relative to the same. Both of these gears are intermeshed with the coupling member 58 (FIG. 4) and function to transmit the drive force from the coupling member 58 to the developing roller 17 and the supply roller 18, respectively.

3. Structure of the Main Casing

The main casing 2 includes the motor 81 shown in FIG. 2, four sensor units 82 shown in FIG. 5(*a*)(only one of which is shown in FIG. 5(*a*)), and a CPU 83 shown in FIG. 5(*a*).

As shown in FIG. 2, the motor 81 inputs the drive force into the coupling member 58 of each developer cartridge 13 via the male coupling member (not shown).

The four sensor units 82 (FIG. 5(*a*)) are provided in the main casing 2 to confront with the four process-side actuators 41 when the process unit 9 is mounted in the main casing 2. As shown in FIG. 5(*a*), each sensor unit 82 includes a photosensor 84 and a casing-side actuator 85.

In a front-side view, the photosensor 84 is substantially U-shaped, with the opening of the "U" on the right side. The photosensor 84 is fixed to the main casing 2 and is connected to the CPU 83. The photosensor 84 includes a light-emitting element 86 and a light-receiving element 87.

The light-emitting element 86 and the light-receiving element 87 are disposed in vertical opposition to each other. A detection light emitted from the light-emitting element 86 is received in the light-receiving element 87. The light-emitting element 86 constantly emits the detection light. The photosensor 84 transmits a light reception signal (ON) to the CPU 83 when the light-receiving element 87 is receiving the detection light, and does not transmit the light reception signal (OFF) to the CPU 83 when the light-receiving element 87 is not receiving the detection light.

The casing-side actuator 85 is substantially rod-shaped and extends in the front-to-rear direction. The casing-side actuator 85 includes a support shaft 88, a contact part 89, and a light-shielding part 90.

The support shaft 88 is provided midway in the casing-side actuator 85 along the front-to-rear direction. The support shaft 88 is substantially cylindrical in shape and extends vertically.

The contact part 89 is substantially rectangular column shape and protrudes rightward from the rear end of the casing-side actuator 85. The light-shielding part 90 is plate-shaped and protrudes leftward from the front end of the casing-side actuator 85.

The casing-side actuator 85 is disposed such that the contact part 89 of the casing-side actuator 85 opposes the detection target part 45 of the process-side actuator 41 in the left-to-right direction when the process unit 9 is mounted in the main casing 2. The casing-side actuator 85 is rotatably supported on the support shaft 88 and is capable of rotating relative to the main casing 2 in the horizontal plane. The light-shielding part 90 of the casing-side actuator 85 is positioned between the light-emitting element 86 and the light-receiving element 87 of the photosensor 84.

A coil spring (not shown) is provided for constantly urging the casing-side actuator 85 clockwise in a plan view. Through this construction, the light-shielding part 90 is usually located between the light-emitting element 86 and the light-receiving element 87 to interrupt the detection light emitted from the light-emitting element 86.

When the detection target part 45 of the process-side actuator 41 contacts the contact part 89 of the casing-side actuator 85, the casing-side actuator 85 rotates counterclockwise in a plan view against the urging force of the coil spring, causing the light-shielding part 90 to retract rightward from its position between the light-emitting element 86 and the light-receiving element 87. Accordingly, the light-receiving element 87 receives the detection light emitted from the light-emitting element 86.

The CPU 83 is connected to the photosensor 84 and monitors the photosensor 84 for light reception signals at prescribed time intervals.

4. Mounting and Removal of Developer Cartridges Relative to the Main Casing (1) Mounting and Removal of Developer Cartridges Relative to the Process Unit In order to mount the developer cartridges 13 in the main casing 2, the developer cartridges 13 are first mounted in the process frame 12 as shown in FIG. 2.

To mount the developer cartridge 13 in the process frame 12, the operator first grips the handle 52 of the developer cartridge 13 and positions the developer cartridge 13 above the process frame 12, which has been pulled out from the main casing 2, so as to be aligned with the corresponding photosensitive drum 14 in the front-to-rear direction.

Next, the operator lowers the developer cartridge 13 into the process frame 12. As the developer cartridge 13 is inserted into the process frame 12, the left and right ends of the developing roller shaft 73 are fitted into the first guide grooves 32A formed in the left and right side plates 31 from above (FIG. 3(*b*)).

As the left and right ends of the developing roller shaft 73 are sequentially guided along the second sloped surfaces 49 of the contact parts 44 and the first guide grooves 32A, the developer cartridge 13 is inserted into the process frame 12 along the first sloping direction X (FIG. 3(*b*)), i.e., downward along a slightly rearward slope.

After the left and right ends of the developing roller shaft 73 reach the lower ends of the first guide grooves 32A, the operator continues to insert the developer cartridge 13 into the process frame 12.

At this time, the left and right ends of the developing roller shaft 73 are guided along the second guide grooves 32B. Accordingly, the left and right ends of the developing roller shaft 73 are guided into the deepest portions of the second guide grooves 32B along the second sloped direction Y (FIG. 3(*b*)), i.e., downward along a more pronounced rearward slope.

As the left and right ends of the developing roller shaft 73 reach the deepest portions of the second guide grooves 32B, the bosses 53 on the top portion of the developer cartridge 13 contact the curved portions 39 of the pressing members 36 from the rear.

Next, the operator pivots the developer cartridge 13 forward while gripping the handle 52.

As a result, the developer cartridge 13 pivots forward about the developing roller shaft 73, and the bosses 53 push the corresponding pressing members 36 forward and slide beneath the pressing members 36 as the pressing members 36 are rotated clockwise in a left-side view.

When the bosses 53 slide beneath the pressing members 36, the pressing members 36 engage the bosses 53 from above, and the force of urging members (not shown) pushes the bosses 53 in a direction diagonally downward and rearward (FIG. 3(*b*)).

At this time, the developer cartridge 13 is pushed by the pressing cams 36 in a direction diagonally downward and rearward, and the developing roller shaft 73 is guided by the second guide grooves 32B of the plate 31. Thus, the developer cartridge 13 is pressed to the photosensitive drum 14 from above along the second sloped direction Y.

Through this procedure, the operation for mounting the developer cartridge 13 in the process frame 12 is complete. All developer cartridges 13 are mounted in the process frame 12 according to the same procedure.

In order to remove a developer cartridge 13 from the process frame 12, the operation for mounting the developer cartridge 13 in the process frame 12 is simply reversed in order. That is, the operator first grips the handle 52 and pivots the developer cartridge 13 rearward. While still gripping the handle 52, the operator then pulls the developer cartridge 13 upward to remove the developer cartridge 13 from the process frame 12.

As the developer cartridge 13 is being removed from the process frame 12, the left and right ends of the developing roller shaft 73 are guided sequentially along the second guide grooves 32B, the first guide grooves 32A, and the second sloped surfaces 49 of the contact parts 44.

(2) Mounting and Removal of the Process Unit Relative to the Main Casing

Next, the process unit 9 having all developer cartridges 13 mounted in the process frame 12 is mounted in the main casing 2.

In order to mount the process unit 9 in the main casing 2, the operator inserts the process unit 9 into the main casing 2 in a rearward direction.

At this time, the process unit 9 is guided into the main casing 2 along the guide rails 42 in the rear direction. As shown in FIG. 1, when the process unit 9 is completely inserted into the main casing 2, each of the photosensitive drums 14 contacts the upper portion of the conveying belt 22.

Next, the operator pivots the front cover 5 upward and rearward to close the front cover 5.

The operation for mounting the process unit 9 in the main casing 2 is completed. To remove the process unit 9 from the main casing 2, the operator pivots the front cover 5 forward and downward and simply pulls the process unit 9 in a forward direction from the main casing 2.

5. Detection Operations

When the process unit 9 is mounted in the main casing 2, as shown in FIG. 5(*a*), the detection target part 45 of each process-side actuator 41 is positioned in opposition to the contact part 89 of the corresponding casing-side actuator 85 in the left-to-right direction, and an warming-up operation is initiated.

In the warming-up operation, as shown in FIG. 2, the male coupling members (not shown) of the main casing 2 couple with the corresponding coupling members 58 from the left, and the drive force from the motor 81 is inputted into the coupling members 58. The drive force inputted into the coupling members 58 is transmitted to the corresponding detection gears 56 (FIG. 5(*a*)) via gear trains (not shown).

Figure 6:
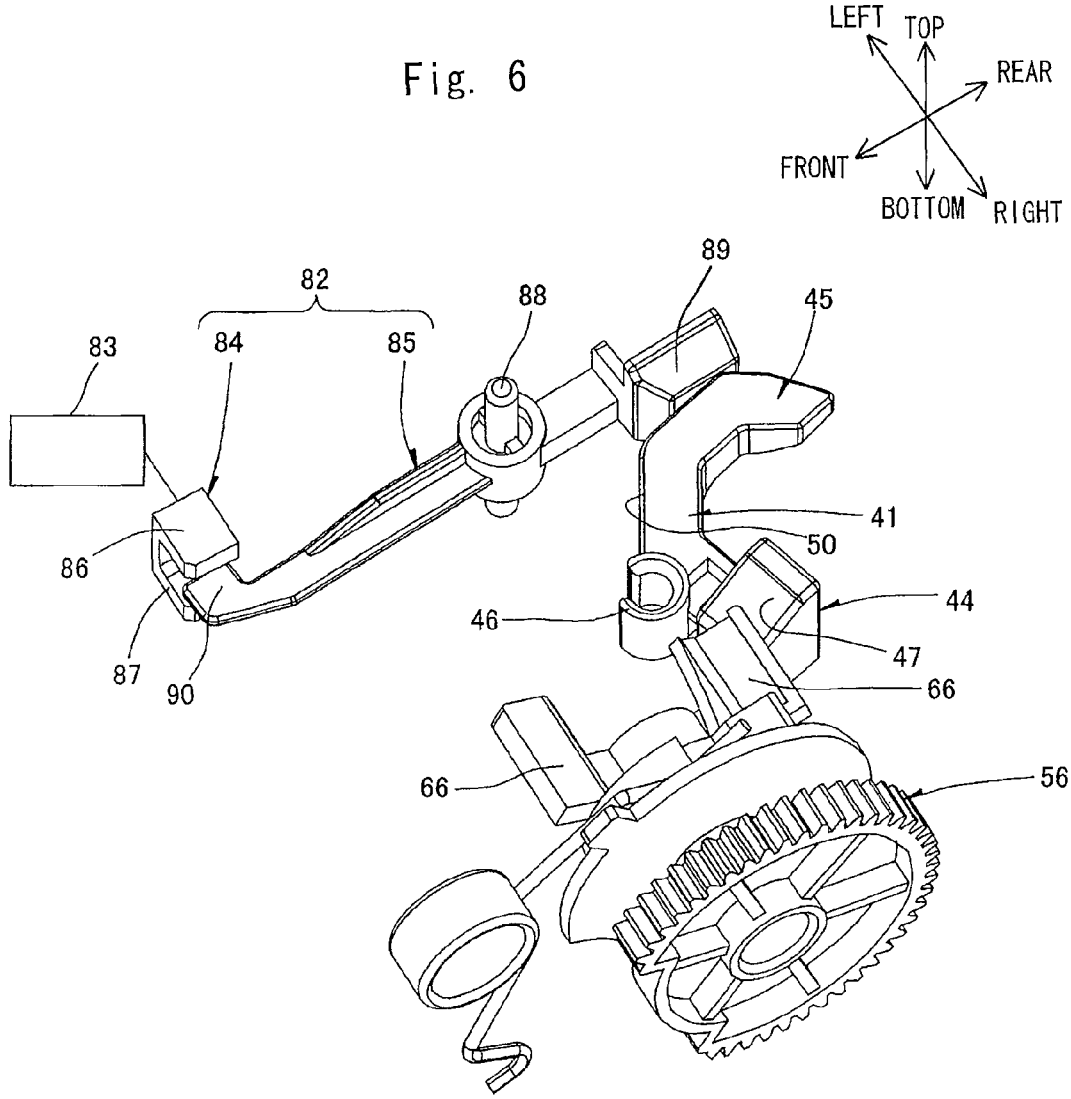
FIG. 6 is a diagram explaining the detection operation when the detection gear contacts a first sloped surface of the process-side actuator.

When a drive force is transmitted to each detection gear 56, the detection gear 56 rotates clockwise in a right-side view, as shown in FIG. 6. As the detection gear 56 rotates, the contact protrusions 66 also move clockwise in a right-side view and the one contact protrusion 66 contacts the first sloped surface 47 formed on the process-side actuator 41 from above in a contacting direction, i.e., a rotational direction of the contact protrusion 66.

Through the slope of the first sloped surface 47, the one contact protrusion 66 pushes the contact part 44 rearward, causing the process-side actuator 41 to rotate counterclockwise in a plan view about the support shaft 61 against the urging force of the coil spring 30 (FIG. 5(*b*)). As the process-side actuator 41 rotates counterclockwise, the detection target part 45 protrudes leftward from the left side surface of the guide rail 42 of the side plate 31. During this rotation, the process-side actuator 41 is guided by top and bottom inner walls of the accommodating part 43.

When protruding leftward of the guide rail 42, the detection target part 45 contacts the contact part 89 on the casing-side actuator 85 from the right side, causing the casing-side actuator 85 to begin rotating counterclockwise in a plan view. As the casing-side actuator 85 rotates counterclockwise, the light-shielding part 90 begins to retract toward the right from its position between the light-emitting element 86 and the light-receiving element 87.

As long as the contact protrusion 66 remains in contact with the first sloped surface 47, the detection target part 45 has not reached a maximum distance of protrusion from the process frame 12 (hereinafter referred to as a maximum protruding state) and, hence, the left edge of the light-shielding part 90 remains interposed between the light-emitting element 86 and the light-receiving element 87. Consequently, the light-shielding part 90 continues to block the detection light emitted from the light-emitting element 86.

Figure 9:
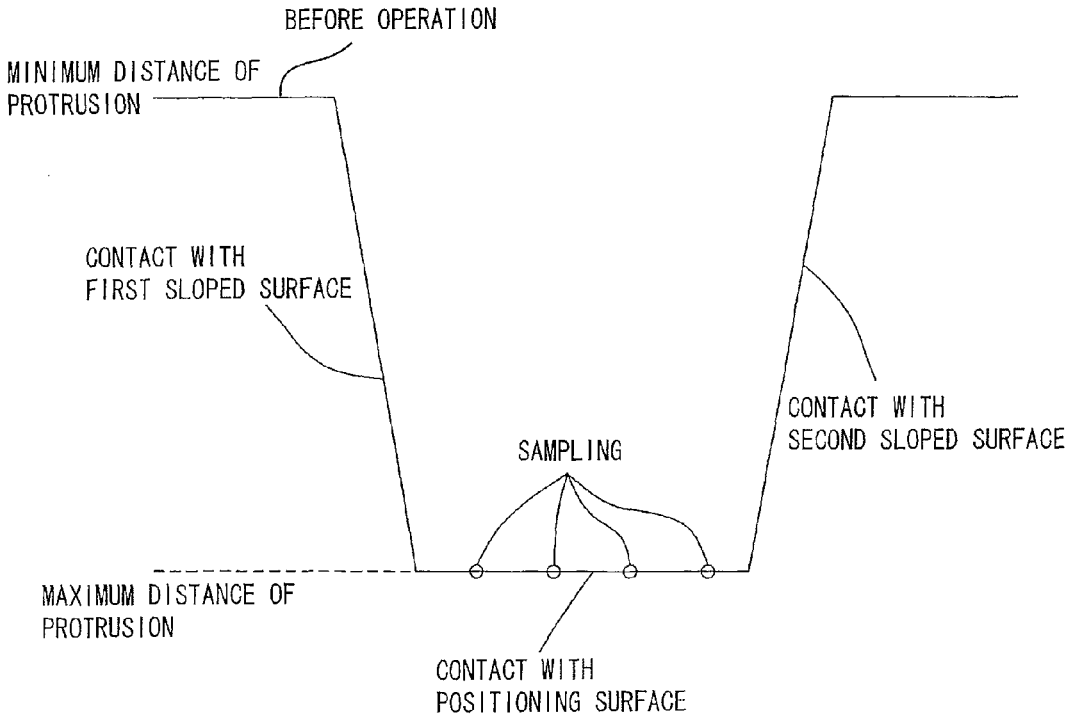
FIG. 9 is a diagram explaining a relationship between a movement of the process-side actuator and a detection result of a sensor unit.

Hence, the sensor unit 82 has not yet detected protrusion of the detection target part 45 in this state ("contact with first sloped surface" in FIG. 9.)

Figure 7:
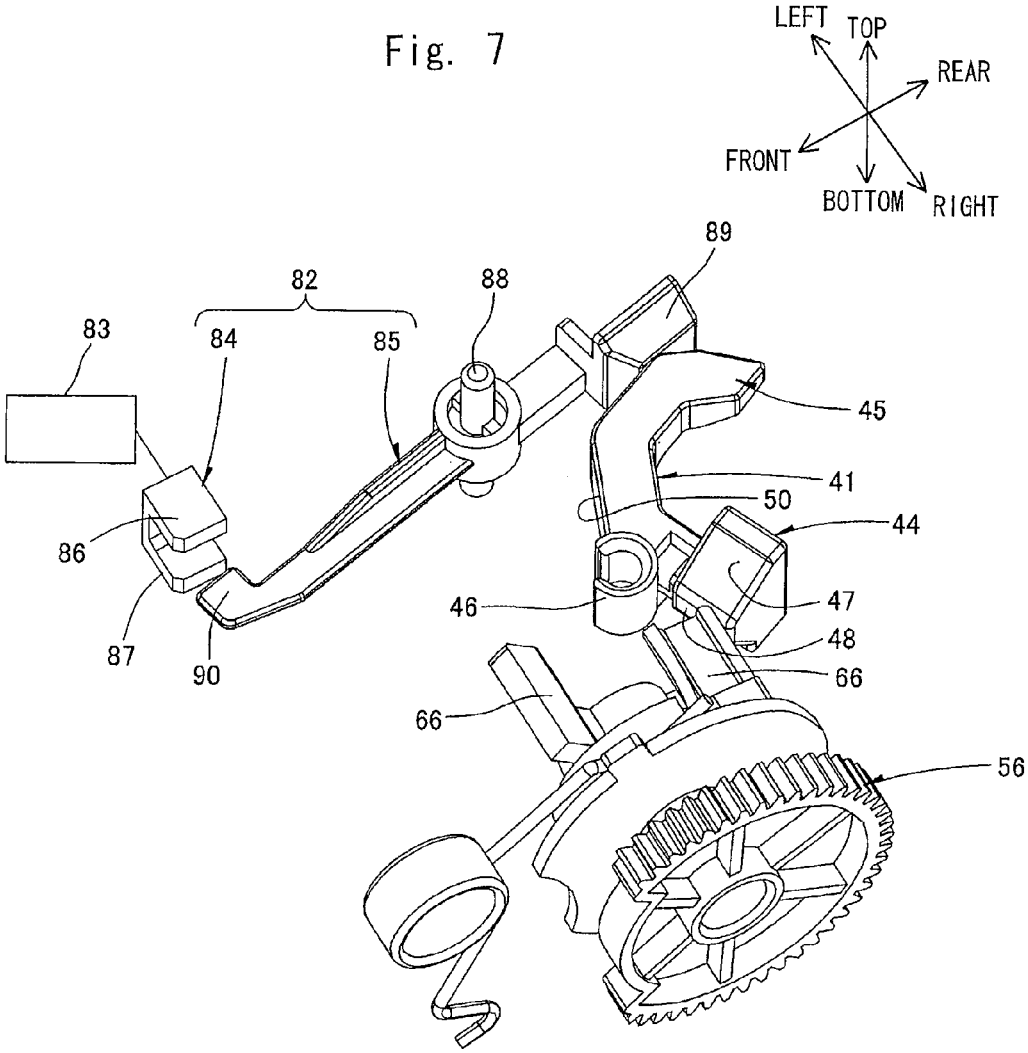
FIG. 7 is a diagram explaining the detection operation when the detection gear contacts a positioning surface of the process-side actuator.

As the detection gear 56 continues to rotate, the one contact protrusion 66 slides off the first sloped surface 47 and contacts the positioning surface 48 from the front side, as shown in FIG. 7.

At this point, the detection target part 45 has reached the maximum protruding state and is disposed in a detection position. Further, the light-shielding part 90 of the casing-side actuator 85 has completely retracted from a position between the light-emitting element 86 and the light-receiving element 87 so that the light-receiving element 87 can receive the detection light emitted from the light-emitting element 86.

Hence, the sensor unit 82 detects the protrusion of the detection target part 45 in this state ("contact with positioning surface" in FIG. 9.)

While the one contact protrusion 66 continues to rotate but remains in contact with the positioning surface 48 extending in the contacting direction, the orientation of the process-side actuator 41 is still maintained, with the detection target part 45 in the detection position. In other words, the contact between the one contact protrusion 66 and the positioning surface 48 fixes the position of the process-side actuator 41 so that the detection target part 45 is maintained in the maximum protruding state.

While the detection target part 45 is maintained in the maximum protruding state, the CPU 83 receives the light reception signal from the photosensor 84 a plurality of times (four times in the preferred embodiment; "sampling" in FIG. 9), enabling the CPU 83 to detect the protrusion of the detection target part 45 reliably.

As the detection gear 56 continues to rotate, the one contact protrusion 66 slides off the positioning surface 48 and contacts the second sloped surface 49 from the front side, as illustrated in FIG. 8. In other words, the one contact protrusion 66 passes over the contact part 44.

Consequently, the urging force of the coil spring 30 rotates the process-side actuator 41 clockwise in a plan view as the detection gear 56 continues to rotate. Hence, the detection target part 45 shifts from the detection position back to the accommodated position and is thereby retracted from the casing-side actuator 85.

Further, as the detection target part 45 is retracted from the contact part 89, the urging force of the coil spring (not shown) rotates the casing-side actuator 85 clockwise in a plan view. Consequently, the light-shielding part 90 is once again interposed between the light-emitting element 86 and the light-receiving element 87 and blocks the detection light emitted from the light-emitting element 86.

Accordingly, the sensor unit 82 does not detect the protrusion of the detection target part 45 in this state ("contact with second sloped surface" in FIG. 9.)

As described above, the photosensor 84 detects the protrusion of the process-side actuator 41, and the CPU 83 determines information related to the developer cartridge 13, such as whether the developer cartridge 13 is a new developer cartridge and the number of sheets that can be printed by the developer cartridge 13, based on these detection results.

More specifically, the CPU 83 determines that the developer cartridge 13 is a new cartridge when one of the two contact protrusions 66 on the detection gear 56 (the contact protrusion 66 on the downstream side relative to the rotating direction of the detection gear 56) passes over the process-side actuator 41.

Further, the number of contact protrusions 66 corresponds to the number of sheets that can be printed with the developer cartridge 13. For example, if the detection gear 56 has only one contact protrusion 66, the developer cartridge 13 can print 3,000 sheets. If the detection gear 56 has two contact protrusions 66, the developer cartridge 13 can print 6,000 sheets.

In the preferred embodiment, the detection gear 56 is provided with two contact protrusions 66. Therefore, the CPU 83 determines that the developer cartridge 13 can print 6,000 sheets when the photosensor 84 detects the protrusion of the process-side actuator 41 twice.

After the detection gear 56 has rotated counterclockwise in a left-side view at a prescribed amount (four-fifths of the periphery of the detection gear 56 provided with gear teeth), the portion of the detection gear 56 without gear teeth has rotated opposite the gear train (not shown), and consequently the detection gear 56 comes into a halt.

6. Protection of the Process-Side Actuator

If the power to the printer 1 is unexpectedly interrupted during the detection operation described above, the detection gear 56 may be halted while the process-side actuator 41 is protruding from the guide rail 42 of the process frame 12.

As shown in FIG. 7, when the process-side actuator 41 protrudes from the process frame 12, the pressing surface 50 of the detection target part 45 slopes leftward from front to rear.

Therefore, if the process unit 9 is pulled out from the main casing 2 while the process-side actuator 41 is protruding from the process frame 12, peripheral parts within the main casing 2 may contact the pressing surface 50 from front side.

In such a case, the peripheral parts will apply pressure to the pressing surface 50, and then the process-side actuator 41 rotates clockwise in a plan view.

Accordingly, the detection target part 45 shifts from the detection position back to the accommodated position inside the accommodating part 43.

7. Effects of the Preferred Embodiment

In the color laser printer 1 according to the preferred embodiment, the process-side actuator 41 includes the support shaft 61 oriented vertically, as shown in FIGS. 5(*a*) and 5(*b*). The process-side actuator 41 is provided in the process frame 12 so as to be capable of rotating about the support shaft 61. Therefore, the process-side actuator 41 can rotate clockwise in a plan view. Since the clockwise rotation occurs in the horizontal plane, the process-side actuator 41 can rotate when interfered with the peripheral parts in the main casing 2, thereby absorbing such interference. As a result, this structure can prevent the process-side actuator 41 from being damaged.

In the color laser printer 1 of the preferred embodiment, the detection target part 45 of the process-side actuator 41 is normally disposed in the accommodated position. The detection target part 45 moves from the accommodated position to the detection position, protruding out from the guide rail 42, only when the contact protrusion 66 of the detection gear 56 contacts the contact part 44. Accordingly, the guide rail 42 can be used for accommodating the process-side actuator 41, without forming a separate space for that purpose. This construction enables the process frame 12 to be designed more compactly and, hence, for the color laser printer 1 to be made more compactly.

In the color laser printer 1 according to the preferred embodiment, the detection target part 45 is reliably maintained in the accommodated position by the urging force of the coil spring 30.

In the color laser printer 1 according to the preferred embodiment, as shown in FIG. 6, the contact protrusion 66 of the detection gear 56 contacts the first sloped surface 47 of the contact part 44 from above so that the contact part 44 can be moved rearward. Accordingly, after contacting the contact part 44, the contact protrusion 66 can pass over the contact part 44 in a downward direction while the contact part 44 is retracted rearward.

In the color laser printer 1 according to the preferred embodiment, the detection target part 45 can be maintained at the maximum protruding state, while the contact protrusion 66 contacts the positioning surface 48, as shown in FIG. 7. Hence, the sensor unit 82 can reliably detect the protrusion of the detection target part 45 while the contact protrusion 66 remains in contact with the positioning surface 48, as illustrated in FIG. 9.

In the color laser printer 1 according to the preferred embodiment, as shown in FIG. 8, the developer cartridge 13 can be guided along the second sloped surface 49 when removing the developer cartridge 13 from the process frame 12. Therefore, the developer cartridge 13 can be removed from the process frame 12 smoothly.

In the color laser printer 1 according to the preferred embodiment, the second sloped surface 49 follows the first sloping direction X, as shown in FIG. 3(*b*). Therefore, the developer cartridge 13 can be guided by the second sloped surface 49, as well as the guide ribs 33, when mounted and removed, enabling the developer cartridge 13 to be smoothly mounted in and removed from the process frame 12.

In the color laser printer 1 according to the preferred embodiment, the detection target part 45 can be shifted from the detection position back to the accommodated position through pressure applied to the pressing surface 50 of the detection target part 45. When the detection target part 45 is in the detection position, i.e., is protruding from the guide rail 42 of the process frame 12, the detection target part 45 can retract from the detection position back to the accommodated position when the peripheral parts in the main casing 2 contact the pressing surface 50 as the process unit 9 is removed from the main casing 2, enabling the detection target part 45 to avoid such interference. As a result, it is possible to prevent damage to the detection target part 45 caused by the peripheral parts that interfere with the same.

In the color laser printer 1 according to the preferred embodiment, the rotation of the process-side actuator 41 can be guided by top and bottom inner walls of the accommodating part 43 formed in the guide rail 42. With this construction, the process-side actuator 41 can be rotated smoothly.

What is claimed is:

1. An image forming device comprising:

a main body;

a support unit that is disposed in the main body and that is configured to be pulled out from the main body in a removing direction, the support unit supporting a photosensitive member;

a driving unit provided in the main body;

a developer cartridge detachably mountable in the support unit and having a developer member and a driving member, wherein the driving member is configured to be driven by the driving unit at a prescribed amount when the developer cartridge is mounted in the support unit;

a moving member configured to move when the driving member is driven by the driving unit;

a transmitting member provided to the support unit and rotatable about a rotational axis which extends perpendicular to both the removing direction and a longitudinal direction of the photosensitive member, wherein when the moving member contacts the transmitting member, the transmitting member configured to rotate to let the moving member pass over the transmitting member;

a detection member that is provided in the main body and that configured to detect a rotation of the transmitting member; and an information determining unit configured to determine an information of the developer cartridge based on detection results of the detection member.

2. The image forming device according to claim 1, wherein the support unit includes a guide member configured to guide an attachment of the support unit with respect to the main body, and the transmitting member includes a contact part that contacts the moving member and a detection target part that configured to be detected by the detection member, wherein the detection target part is movable between a first position at which the detection target part is accommodated in the guide member and a second position at which the detection target part protrudes from the guide member, and the detection target part is normally positioned at the first position, wherein the detection target part configured to move to the second position from the first position when the moving member contacts the contact part.

3. The image forming device according to claim 2, further comprising a biasing member configured to urge the transmitting member so as to position the detection target part at the first position.

4. The image forming device according to claim 2, wherein the contact part has a first sloped surface configured to move, when contacted by the moving member, in a direction intersecting with a contacting direction in which the moving member contacts the contact part.

5. The image forming device according to claim 4, wherein the contact part has a positioning surface extending in the contacting direction for positioning the transmitting member so as to maintain the detection target part at a maximum protruding state, at which the detection target part is protruding from the guide member by a maximum distance, when the moving member is in contact with the positioning surface.

6. The image forming device according to claim 2, wherein the contact part has a second sloped surface configured to guide the developer cartridge when the developer cartridge is removed from the support unit.

7. The image forming device according to claim 6, wherein the support unit includes a developer guide part configured to guide attachment and detachment of the developer cartridge along a developer cartridge attachment/detachment direction, wherein the second sloped surface is formed along the developer cartridge attachment/detachment direction, and both the developer guide part and the second sloped surface are configured to guide attachment and detachment of the developer cartridge.

8. The image forming device according to claim 2, wherein the detection target part has a pressing surface, and the detection target part is configured to be moved from the second position toward the first position when the pressing surface is pressed while the detection target part is at the second position.

9. The image forming device according to claim 2, wherein the guide member is configured to guide the rotation of the transmitting member.

10. An image forming device comprising:

a main body having a driving unit and a detection member;

a support unit that is disposed in the main body and that is configured to be pulled out from the main body in a removing direction, the support unit having a transmitting member configured to rotate about a rotation axis, the detection member detecting a rotation of the transmitting member; and a cartridge detachably mountable in the support unit and configured to accommodate developer, the cartridge having a driving member configured to be driven by the driving unit at a prescribed amount when the cartridge is mounted in the support unit, and a moving member configured to move when the driving member is driven by the driving unit, wherein the transmitting member configured to rotate to let the moving member pass over the transmitting member when the moving member contacts the transmitting member, wherein the rotation axis of the transmitting member extends perpendicular to both the removing direction and a longitudinal direction of the cartridge.

11. The image forming device according to claim 10, wherein the main body has an information determining unit configured to determine an information of the cartridge based on detection results of the detection member.

12. The image forming device according to claim 10, wherein the support unit includes a guide member configured to guide an attachment of the support unit with respect to the main body, and the transmitting member includes a contact part that contacts the moving member and a detection target part that is configured to be detected by the detection member, wherein the detection target part is movable between a first position at which the detection target part is accommodated in the guide member and a second position at which the detection target part protrudes from the guide member, and the detection target part is normally positioned at the first position, wherein the detection target part is configured to move to the second position from the first position when the moving member contacts the contact part.

13. The image forming device according to claim 12, further comprising a biasing member configured to urge the transmitting member so as to position the detection target part at the first position.

14. The image forming device according to claim 12, wherein the contact part has a first sloped surface configured to move, when contacted by the moving member, in a direction intersecting with a contacting direction in which the moving member contacts the contact part.

15. The image forming device according to claim 14, wherein the contact part has a positioning surface extending in the contacting direction for positioning the transmitting member so as to maintain the detection target part at a maximum protruding state, at which the detection target part is protruding from the guide member by a maximum distance, when the moving member is in contact with the positioning surface.

16. The image forming device according to claim 12, wherein the contact part has a second sloped surface configured to guide the cartridge when the cartridge is removed from the support unit.

17. The image forming device according to claim 16, wherein the support unit includes a guide part configured to guide attachment and detachment of the cartridge along a cartridge attachment/detachment direction, wherein the second sloped surface is formed along the cartridge attachment/detachment direction, and both the guide part and the second sloped surface are configured to guide attachment and detachment of the cartridge.

18. The image forming device according to claim 12, wherein the detection target part has a pressing surface, and the detection target part is configured to be moved from the second position toward the first position when the pressing surface is pressed while the detection target part is at the second position.

19. The image forming device according to claim 12, wherein the guide member is configured to guide the rotation of the transmitting member.

20. A support unit capable of being pulled out from an image forming device in a removing direction, the support unit comprising:

a main frame;

a transmitting member configured to rotate about a rotation axis; and a cartridge detachably mountable in the main frame and configured to accommodate developer, the cartridge having a driving member driven at a prescribed amount when the cartridge is mounted in the main frame, and a moving member configured to move when the driving member is driven, wherein the transmitting member is configured to rotate to let the moving member pass over the transmitting member when the moving member contacts the transmitting member;

wherein the rotation axis of the transmitting member extends perpendicular to both the removing direction and a longitudinal direction of the cartridge.

21. The support unit according to claim 20, further comprising a guide member configured to guide an attachment to the image forming device, wherein the transmitting member includes a contact part that contacts the moving member and a detection target part, wherein the detection target part is movable between a first position at which the detection target part is accommodated in the guide member and a second position at which the detection target part protrudes from the guide member, and the detection target part is normally positioned at the first position, wherein the detection target part is configured to move to the second position from the first position when the moving member contacts the contact part.

22. The support unit according to claim 21, further comprising a biasing member configured to urge the transmitting member so as to position the detection target part at the first position.

23. The support unit according to claim 21, wherein the contact part has a first sloped surface configured to move, when contacted by the moving member, in a direction intersecting with a contacting direction in which the moving member contacts the contact part.

24. The support unit according to claim 23, wherein the contact part has a positioning surface extending in the contacting direction for positioning the transmitting member so as to maintain the detection target part at a maximum protruding state, at which the detection target part is protruding from the guide member by a maximum distance, when the moving member is in contact with the positioning surface.

25. The support unit according to claim 21, wherein the contact part has a second sloped surface configured to guide the cartridge when the cartridge is removed from the main frame.

26. The support unit according to claim 25, further comprising a guide part configured to guide attachment and detachment of the cartridge along a cartridge attachment/detachment direction, wherein the second sloped surface is formed along the cartridge attachment/detachment direction, and both the guide part and the second sloped surface are configured to guide attachment and detachment of the cartridge.

27. The support unit according to claim 21, wherein the detection target part has a pressing surface, and the detection target part is moved from the second position toward the first position when the pressing surface is pressed while the detection target part is at the second position.

28. The support unit according to claim 21, wherein the guide member is configured to guide the rotation of the transmitting member.

* * * * *